US007226063B2

(12) United States Patent
Paddock

(10) Patent No.: US 7,226,063 B2
(45) Date of Patent: Jun. 5, 2007

(54) ALL-TERRAIN BOARD

(76) Inventor: Timothy Paddock, 49 Fishguard Road, Llanishen, Cardiff, CF14 5PQ (GB)

( * ) Notice: Subject to any disclaimer, the term of this patent is extended or adjusted under 35 U.S.C. 154(b) by 54 days.

(21) Appl. No.: 10/772,562

(22) Filed: Feb. 5, 2004

(65) Prior Publication Data

US 2004/0155421 A1 Aug. 12, 2004

Related U.S. Application Data

(63) Continuation of application No. PCT/GB02/03640, filed on Aug. 7, 2002.

(51) Int. Cl.
*A63C 17/02* (2006.01)

(52) U.S. Cl. ..... 280/87.042; 280/11.28

(58) Field of Classification Search ..... 280/842, 280/11.27, 11.28, 87.041, 87.042, 11.231, 280/11.233, 79.11, 32.6
See application file for complete search history.

(56) References Cited

U.S. PATENT DOCUMENTS

| | | | | | |
|---|---|---|---|---|---|
| 1,123,686 | A | * | 1/1915 | Cole et al. | 280/87.042 |
| 3,767,220 | A | * | 10/1973 | Peterson | 280/842 |
| 3,990,713 | A | * | 11/1976 | Hokanson | 280/87.042 |
| 4,029,330 | A | * | 6/1977 | Runyan, Jr. | 280/87.042 |
| 4,133,546 | A | * | 1/1979 | Rosenblum | 280/842 |
| 4,235,448 | A | * | 11/1980 | Thomas | 280/842 |
| D302,993 | S | * | 8/1989 | Heilig | D21/765 |
| 4,863,567 | A | * | 9/1989 | Raley | 202/182 |
| 5,160,155 | A | * | 11/1992 | Barachet | 280/87.042 |
| 5,195,781 | A | * | 3/1993 | Osawa | 280/842 |
| 5,267,743 | A | | 12/1993 | Smisek | |
| 5,474,314 | A | * | 12/1995 | Lehman | 280/87.042 |
| 5,622,759 | A | | 4/1997 | Fuster | |
| 5,794,955 | A | * | 8/1998 | Flynn | 280/87.042 |
| 5,997,018 | A | * | 12/1999 | Lee | 280/87.042 |
| 6,254,113 | B1 | * | 7/2001 | Dornan | 280/87.042 |
| 6,279,930 | B1 | * | 8/2001 | Chang et al. | 280/87.042 |
| 6,398,237 | B1 | * | 6/2002 | Attey | 280/87.042 |
| 6,568,695 | B2 | * | 5/2003 | Dornan | 280/87.042 |
| 6,698,776 | B2 | * | 3/2004 | Todd | 280/87.042 |

FOREIGN PATENT DOCUMENTS

| | | | |
|---|---|---|---|
| DE | 4202859 A1 | | 8/1993 |
| EP | 0620031 B1 | * | 10/1994 |

OTHER PUBLICATIONS

Website—http://www.jboards.com/ dated Sep. 11, 2001.

* cited by examiner

*Primary Examiner*—Christopher Bottorff
(74) *Attorney, Agent, or Firm*—Cook, Alex, McFarron, Manzo, Cummings & Mehler, Ltd.

(57) ABSTRACT

An all-terrain board comprises an elongate deck structure 10 having an upper surface on which front and rear axle assemblies 13,14 are mounted, such that the deck structure 10 extends under the axis of wheel rotation. The rear end 12 of the deck structure 10 is upturned and extends rearwardly beyond the rear wheel 15, thereby providing a rear position for one of the rider's feet, which can be used as a kicktail to raise the front end 11 of the board to perform turns and other freestyle maneuvers. The kicktail also enables the front of the board to be raised to clear or mount obstacles.

13 Claims, 14 Drawing Sheets

ALL-TERRAIN BOARD

BACKGROUND OF THE INVENTION

1. Field of the Invention

This application is a continuation of copending PCT International Application Number PCT/GB02/03640 having an International Filing Date of 7 Aug. 2002, and which was published in English as International Publication Number WO 03/013670 A1 on 20 Feb. 2003, and which claims the benefit of priority application GB 0119404.2 filed 9 Aug. 2001. This invention relates to an all-terrain board.

2. Related Background Art

Boards for use in the sport of all-terrain boarding, or mountain boarding are well known. Typically, such all-terrain boards comprise an elongate deck structure having axles adjacent opposite ends thereof, which extend transversely under the deck structure and respectively carry a pair of wheels. Large all-terrain wheels having a diameter of perhaps 7 to 12 inches are provided, since smaller wheels do not perform well on very uneven or rugged terrain and are therefore limited to being used on fairly smooth off-road terrains.

Known all-terrain boards have had problems in achieving the levels of freestyle performance that are available from other board sports such as skateboarding, surfing or snow boarding. Accordingly, the sport of all-terrain boarding has not managed to become a mainstream board sport and remains a peripheral activity with a very small percentage of board riders participating in the sport. Typically, a mainstream board sport will be dominated by 84 to 99% freestyle products, with only 1 to 16% being accounted for by downhill style products, such as known all-terrain boards.

One of the main reasons that known all-terrain boards have not had comparable freestyle performance to boards used in other board sports is because the large all-terrain wheels correspondingly raise the height of the deck structure, thereby making the deck structure too high off the ground for good balance when riding the board: good balance from a low deck structure is necessary for a successful all-terrain board, since off road terrains can be very uneven.

Another problem of a high deck structure on uneven terrain is that it causes speed wobbles. It has been proposed to overcome this problem by increasing the wheelbase of the board. However, a disadvantage of a long board is that they are unsuitable for effecting freestyle maneuvers, and are thus limited to downhill boarding.

Also, a vital factor in good freestyle riding and board control is the provision of an upturned end or so-called kicktail at the rear of the deck structure, on which the rider can place one foot rearwardly of the rear axle and use his weight to pivot the front end of the board upwardly about the rear axle. In this manner, turns can be effected by redirecting the front of the board whilst only the rear wheels are in contact with the ground. The kicktail also enables the front of the board to be raised to clear or mount obstacles: this also allows the rider to effect considerable jumps by springing off the kicktail.

All-terrain boards are known which comprise a kicktail. However, the combination of a kicktail with the relatively high deck structure makes it very difficult to balance when effecting turns and other maneuvers using the kicktail. In order to overcome this problem, it has been proposed to use smaller wheels to correspondingly lower the deck structure. Wheels on such boards usually range between 4 to 6 inches in diameter, resulting in poor performance on uneven terrain.

However, even with a reduced wheel size, known boards still have problems with the deck structure being too high for good balance. In addition to this, the kicktail itself is so high off the ground that its performance is greatly reduced and does not match the sort of freestyle kicktail performance that is available from skate boards.

Another disadvantage of known all-terrain boards is that the axle on the underside of the deck structure can foul obstacles such as rocks and logs. Thus, the board does not have the ability to ride over such obstacles.

I have now devised an all-terrain board which alleviates the above-mentioned problems and which can provide the combination and variety of performance criteria necessary to allow complete board riding in all-terrain environments with a high level of freestyle performance comparable to that which is available from other board sports such as skateboarding, surfing and snow boarding.

SUMMARY OF THE INVENTION

In accordance with this invention, there is provided an all-terrain board comprising an elongate deck structure and wheels mounted at front and rear ends of the deck structure for rotation about respective wheel axes extending transverse the deck structure, the deck structure comprising a central portion disposed between said wheel axes and an upturned rear portion disposed rearwardly of the rearmost wheel axis at said rear end of the deck structure, said central portion of the deck structure extending below the level of a plane defined by said wheel axes and providing a front position for one of the rider's feet, said upturned rear portion of the deck structure extending rearwardly beyond said rearmost wheel and providing a rear position for the rider's other foot.

The all-terrain board has a comparable freestyle performance to boards used in other mainstream board sports, because the deck structure is mounted below the axis of wheel rotation. Thus, even with large wheels, the deck structure is not too high off the ground for good balance when riding the board: good balance from a low deck structure is necessary for a successful all-terrain board, since off road terrains can be very uneven.

Since the board is low, a useable upturned rear end can be provided as a so-called kicktail without significantly affecting the riders balance. In use, the rider can place one foot rearwardly of the rear axle and use his weight to pivot the front end of the board upwardly about the rear axle. In this manner, turns or so-called kick-turns can be effected by redirecting the front of the board whilst only the rear wheels are in contact with the ground. The kicktail also enables the front of the board to be raised to clear or mount obstacles. The kicktail also enables the rider to effect considerable jumps by springing off the kicktail.

The low deck structure makes the board less susceptible speed wobbles. Thus, the board can be made relatively short so that freestyle maneuvers can be effected.

The board is able to ride and slide over irregular obstacles, since the underside of the deck structure is not obstructed by any axles or other structures.

The board thus has a very high level of freestyle performance through providing the combination of a low deck structure, a kicktail, an unobstructed underside and large all-terrain wheels. The all-terrain board also performs very well as a downhill board, therefore providing the variety and combination of performance criteria that are necessary to deliver a complete board riding experience that is comparable skateboarding, surfing or snow boarding in all terrains.

Preferably, the rear upturned end of the board extends upwardly and rearwardly to a point substantially in-line with or above said plane defined by the wheel axes.

The deck structure may comprise raised portions which respectively extend over the wheel axes and a lowered central portion which extends below said plane defined by the wheel axes. However, the deck structure preferably extends under the wheel axes.

Preferably, the wheels are mounted on respective axle assemblies mounted to the upper surface of the deck structure, such that the deck structure is suspended below the wheel axes.

Preferably, the axle assembly of the rear wheels comprises an elongate base that is fixed to the deck structure and extends axially thereof between said central and upturned rear portions of the deck structure. The base thus serves to strengthen the deck structure at the point where it curves upwardly, thereby alleviating the risk of the deck structure breaking under the large forces that would be applied to the upturned end by the rider during use. Alternatively, the deck may be strengthened by a separate longitudinally-extending strengthening member fitted to the surface of the deck structure.

The front end may have a similar structure to the rear end, so that the board can be used in either direction.

Preferably, the axle assemblies comprises an axle the axle being pivotally mounted to the deck structure, so that the rider can steer the board by leaning to cause the assemblies to pivot relative to the deck structure.

Each axle may carry a pair of wheels, respectively mounted at opposite ends of the axle. Alternatively, each axle may only carry a single wheel, thereby creating a board which only has a single front wheel and a single rear wheel.

Preferably, each axle is pivotable against a resilient bias, for example provided by an elastomeric member mounted between the axle and the base of the axle assembly.

In order to prevent undue movement of each end of the axle, each end of the axle is preferably connected to the deck structure or the base of the axle assembly by a member, which limits the angle through which the axle can pivot relative to the board.

Preferably, the member comprises a rigid strut having a coupling at one or both of its ends which allows movement of axle relative to the deck structure.

BREIF DESCRIPTION OF THE DRAWINGS

Embodiments of this invention will now be described by way of example only and with reference to the drawings in which.

Figure 1:
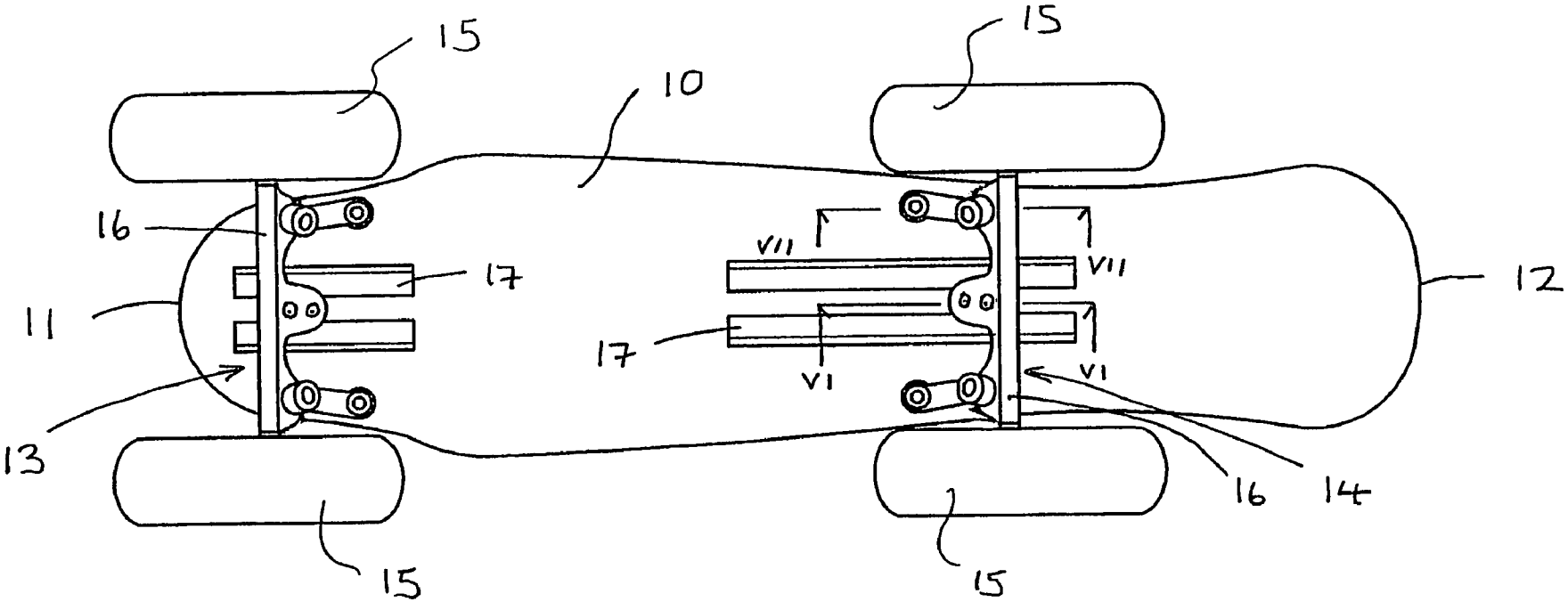
FIG. 1 is a. plan view of an embodiment of all terrain board in accordance with this invention.
Figure 2:
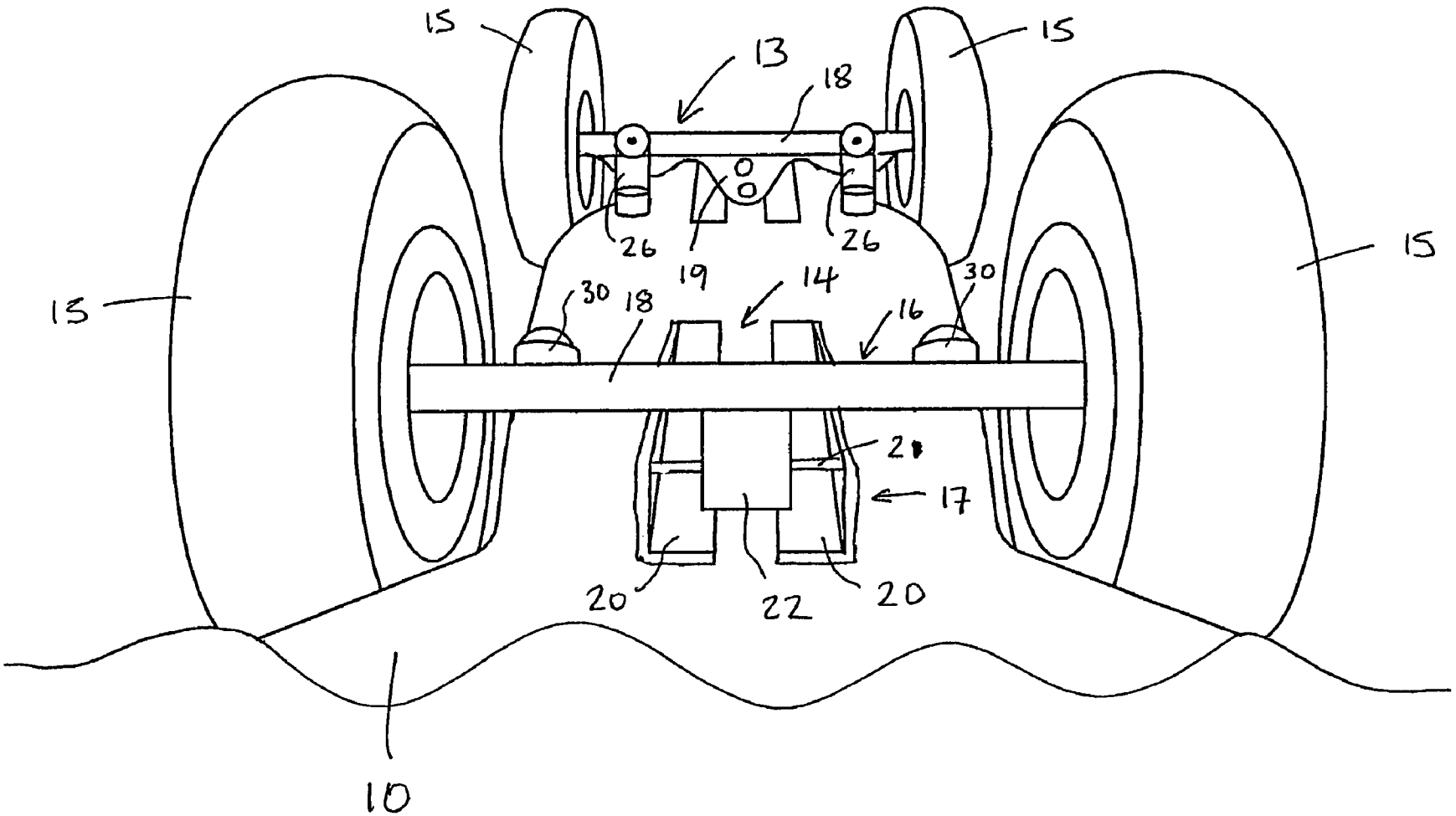
FIG. 2 is a perspective view, from the rear, along the upper side of the deck structure of the board of FIG. 1.
Figure 3:
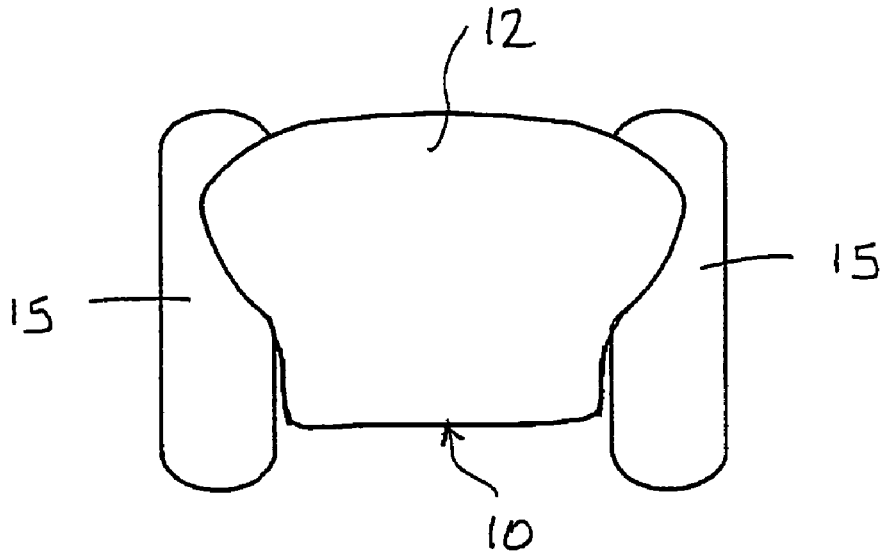
FIG. 3 is a rear view of the board of FIG. 1.
Figure 4:
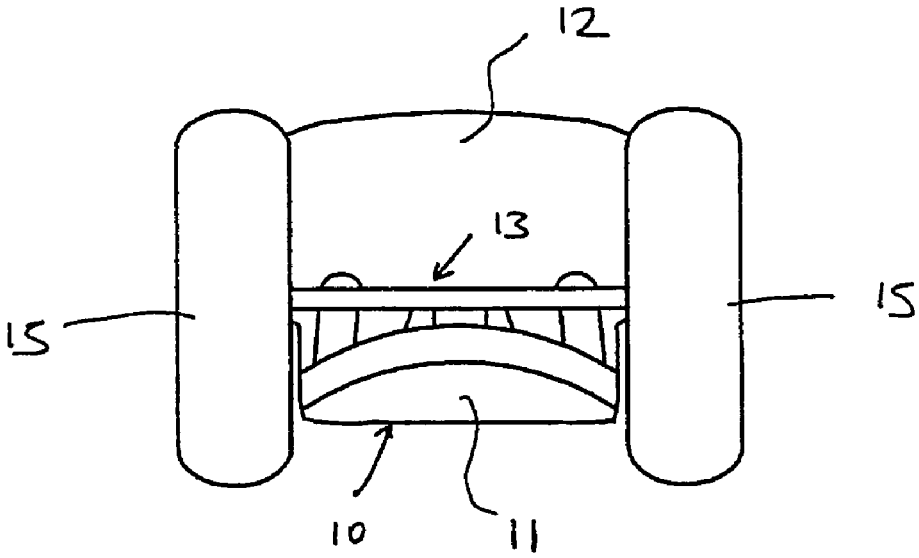
FIG. 4 is a front view of the board in FIG. 1.
Figure 5:
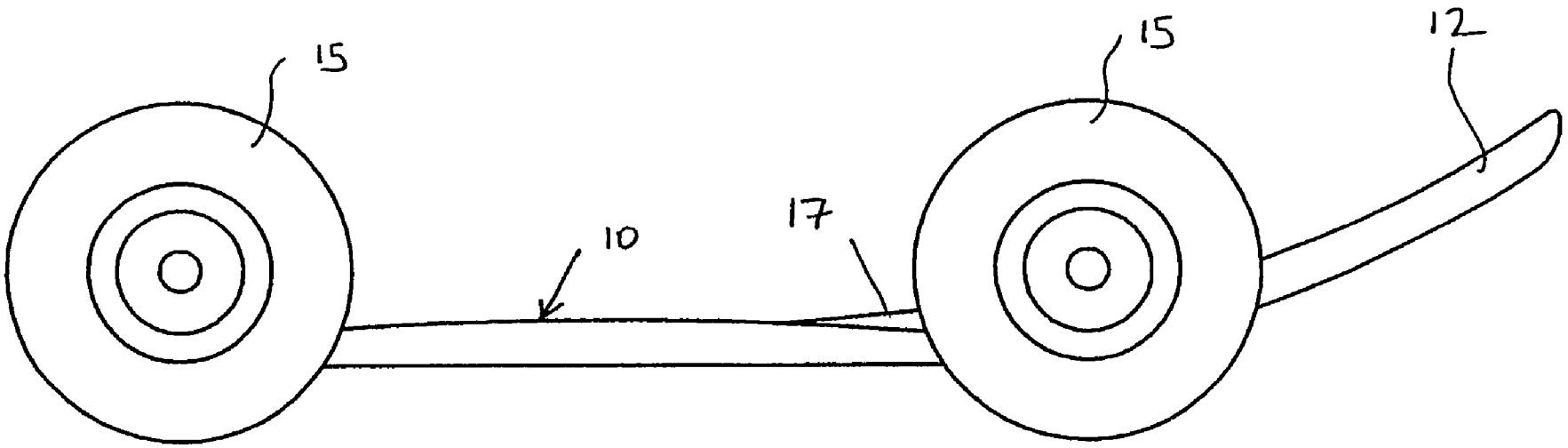
FIG. 5 is a side view of the board in FIG. 1.
Figure 5A:
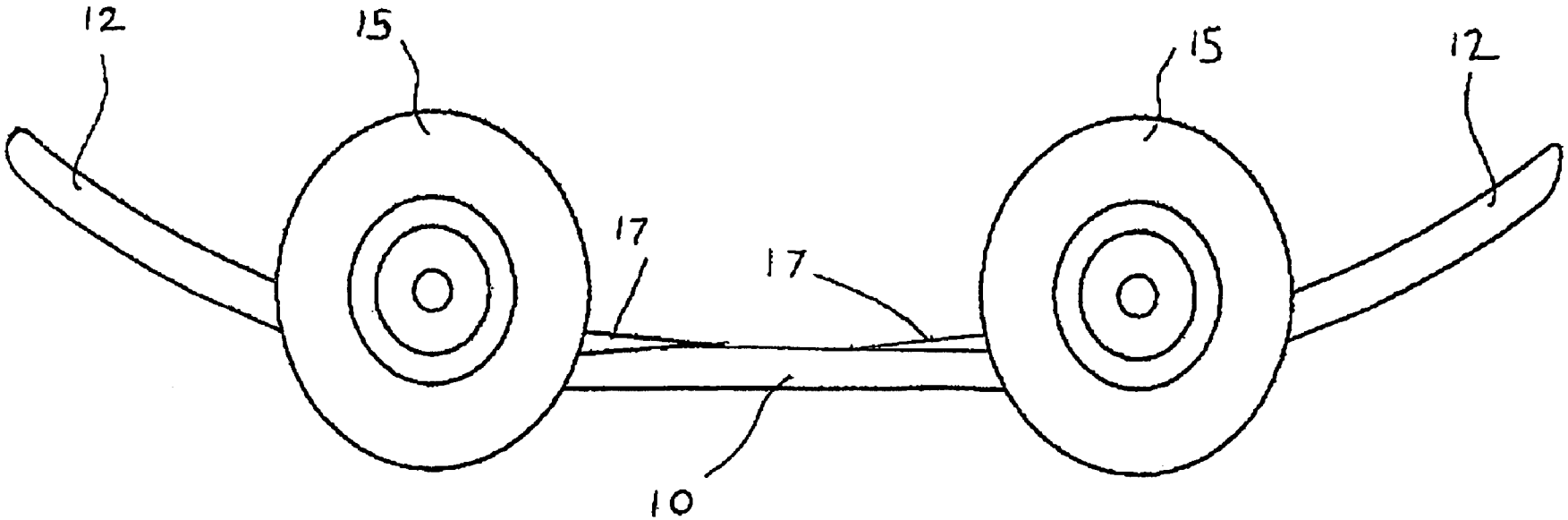
FIG. 5*a* is a side view of an embodiment of an all terrain board showing a front end similar to the rear end.
Figure 5B:
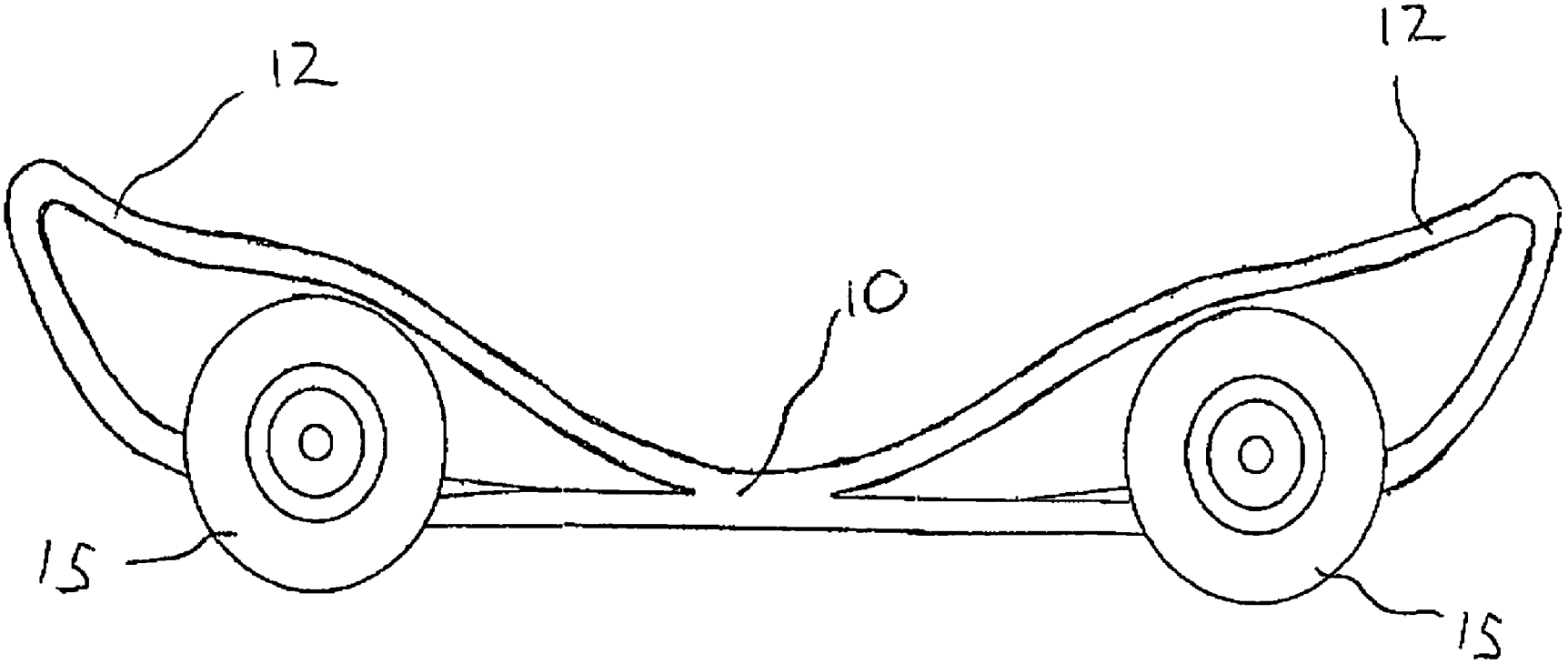
Figure 6:
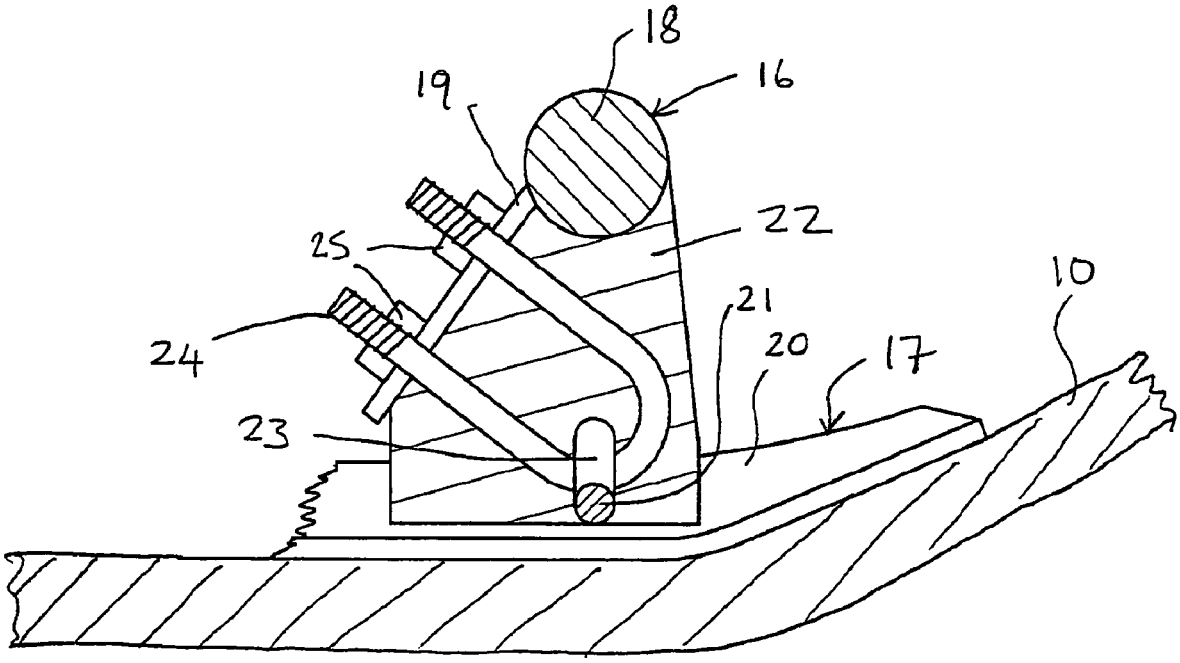
Figure 7:
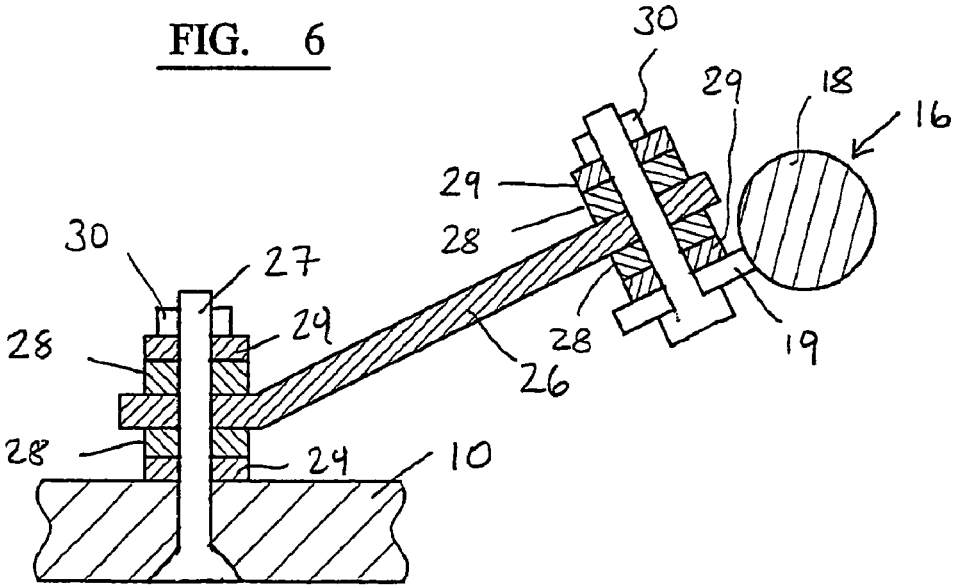
Figure 8:
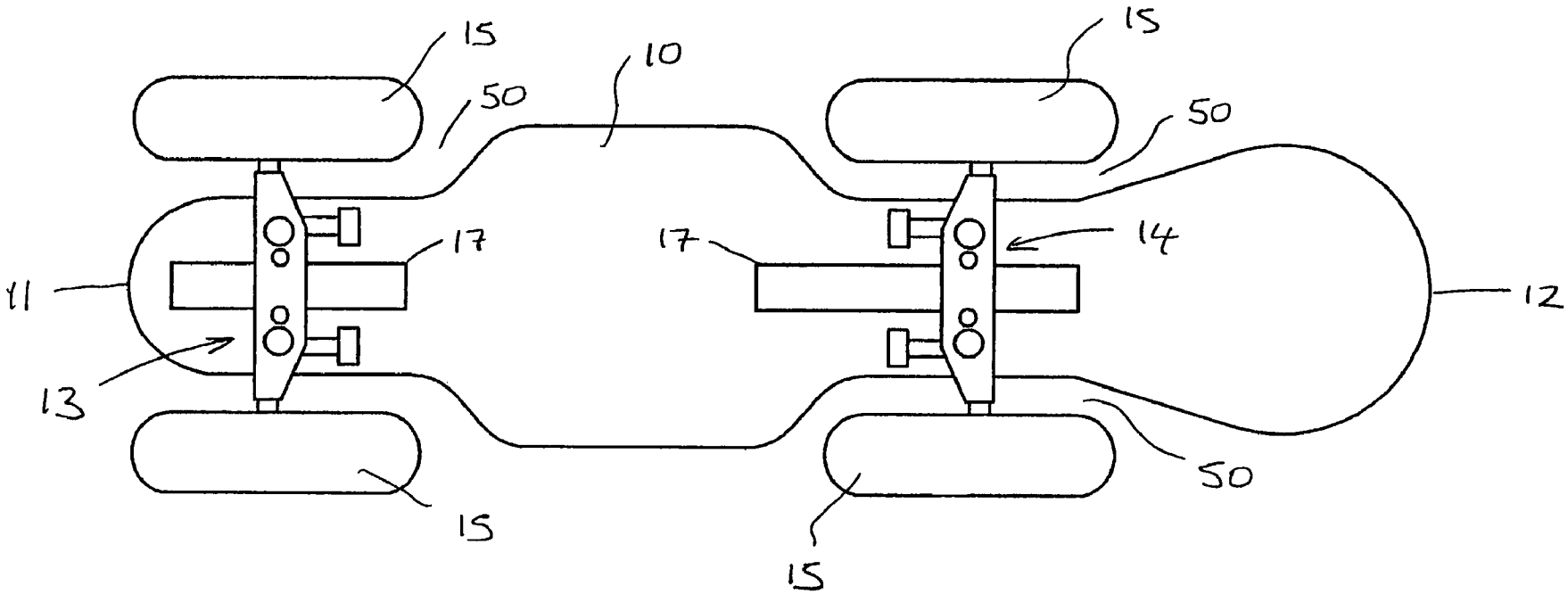
Figure 9:
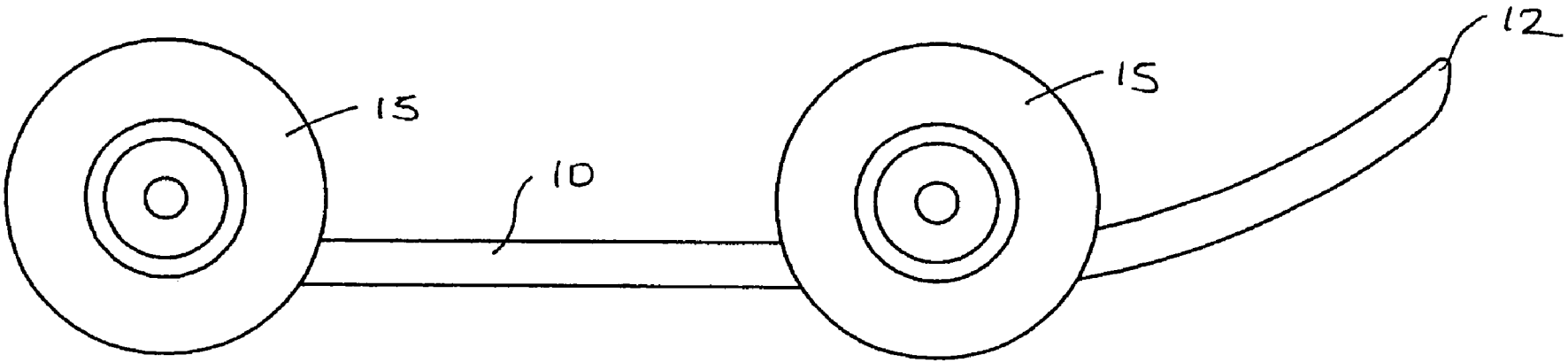
Figure 10:
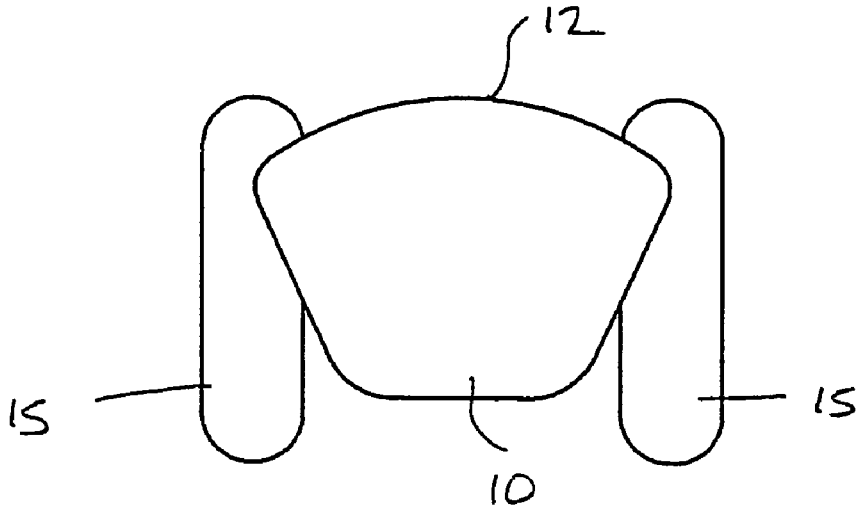
Figure 11:
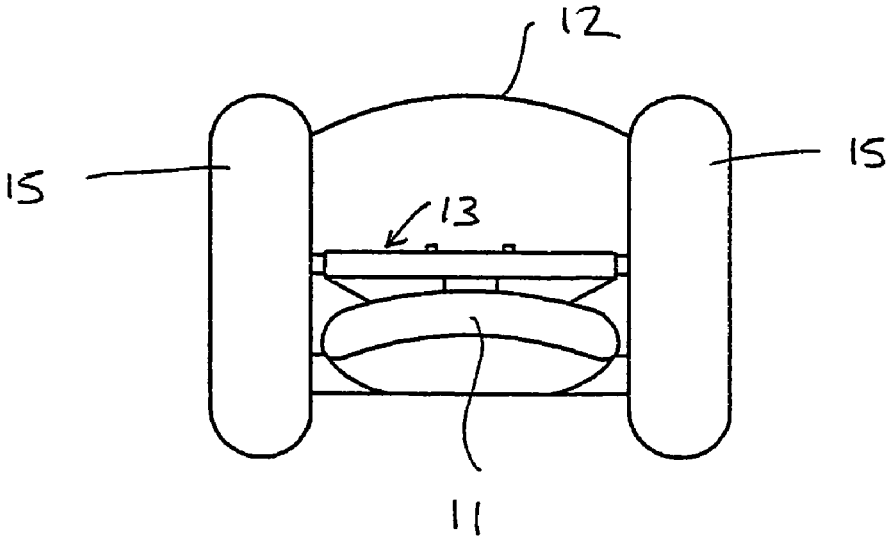
Figure 12:
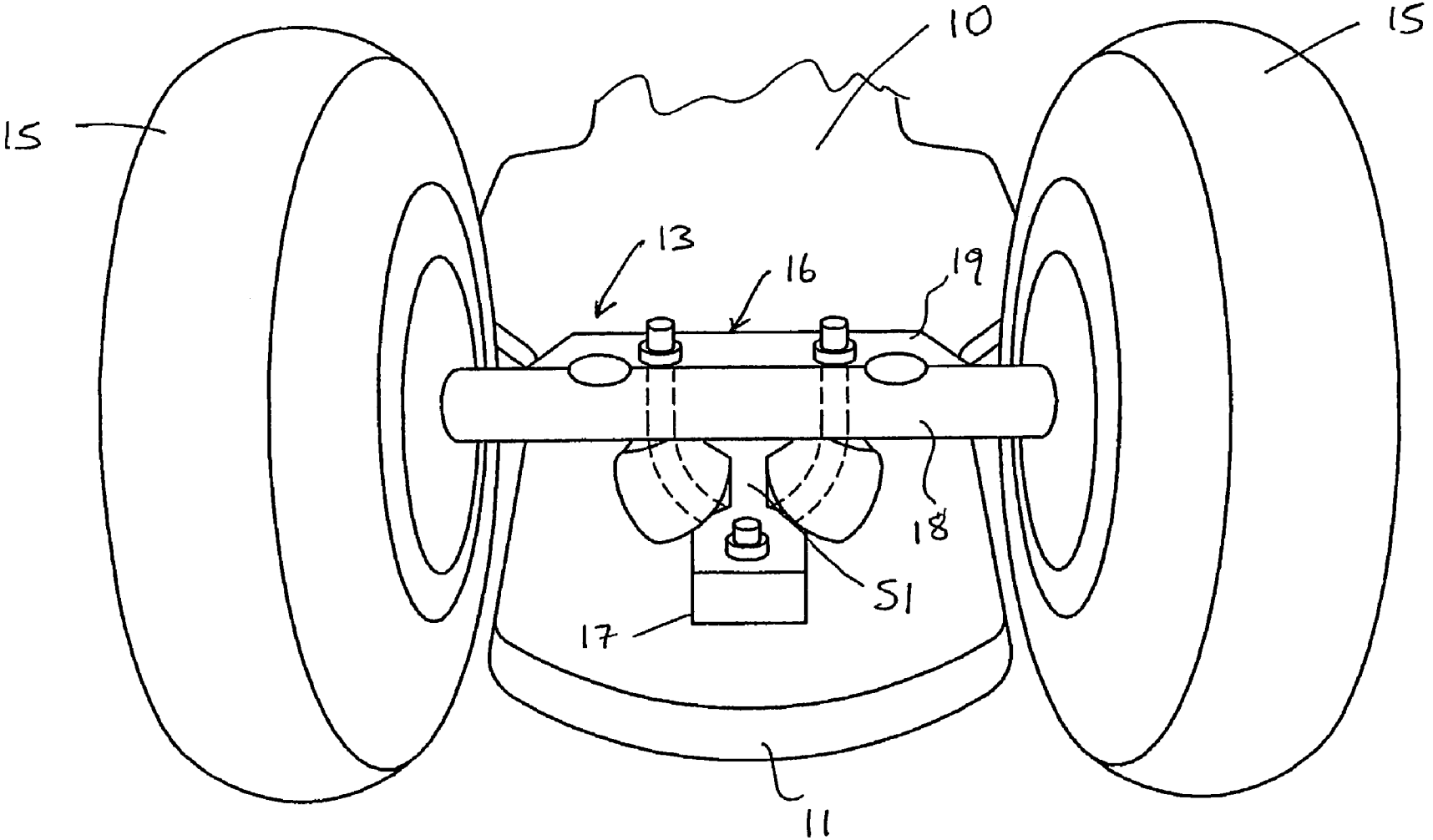
Figure 13:
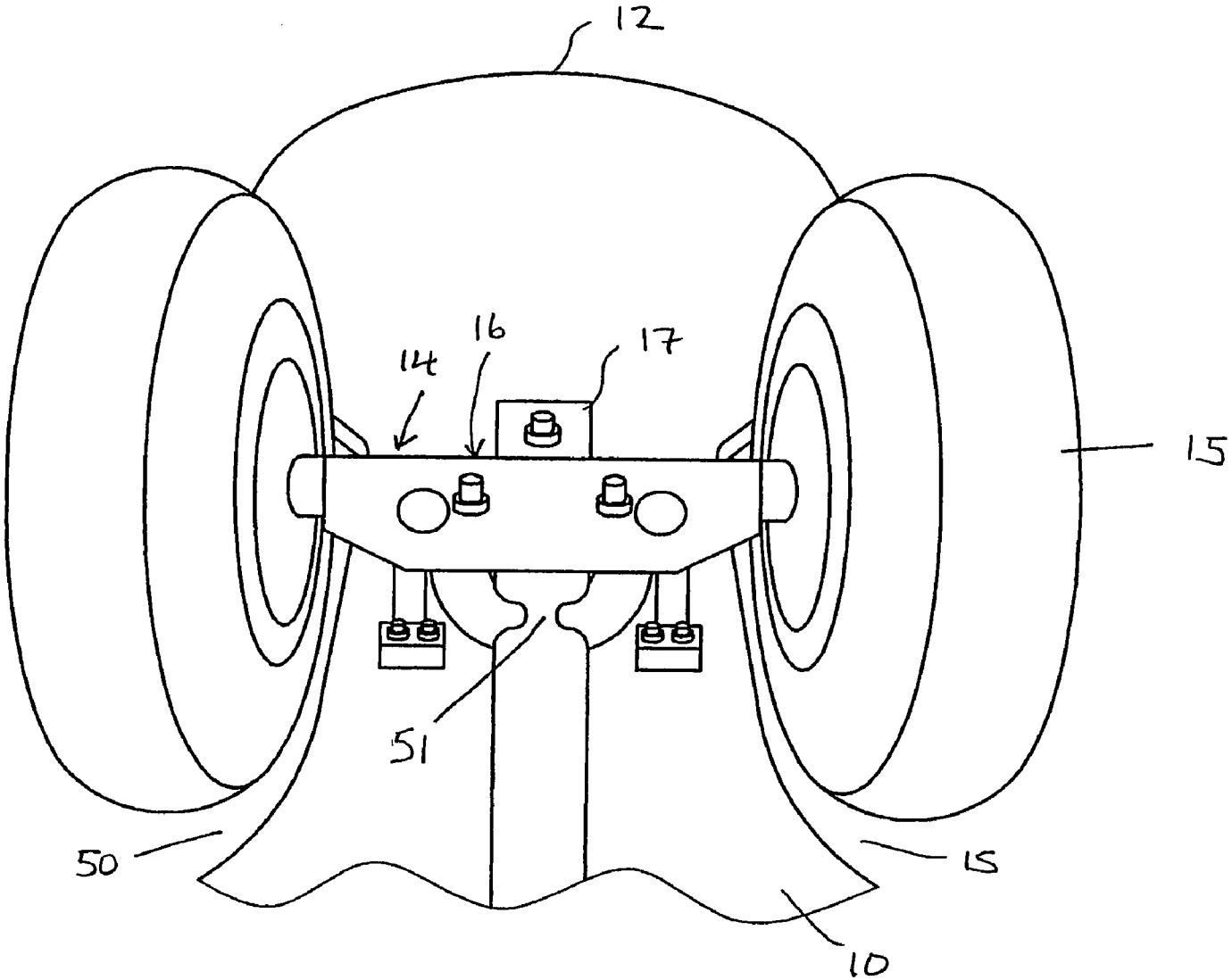
Figure 14:
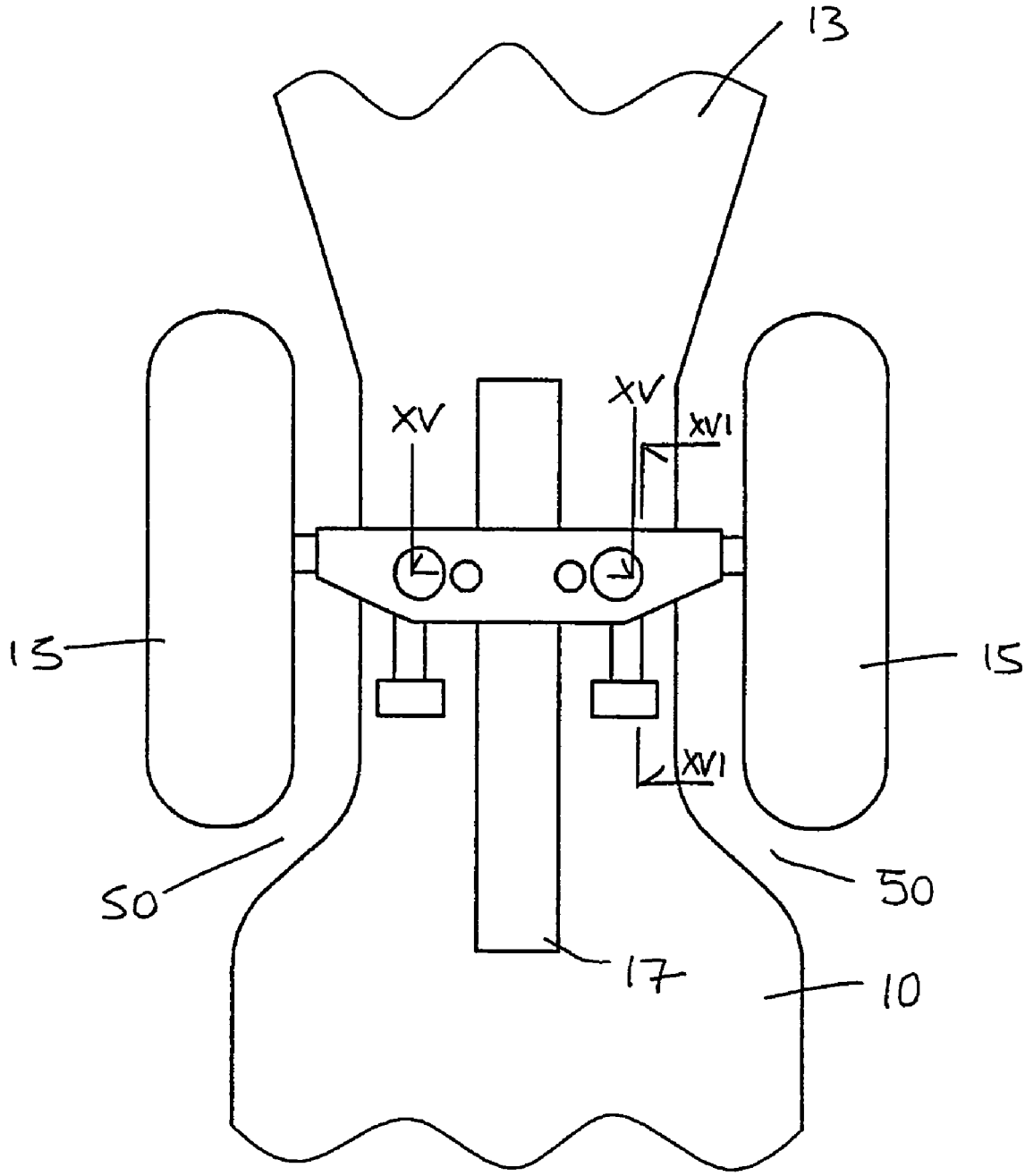
Figure 15:
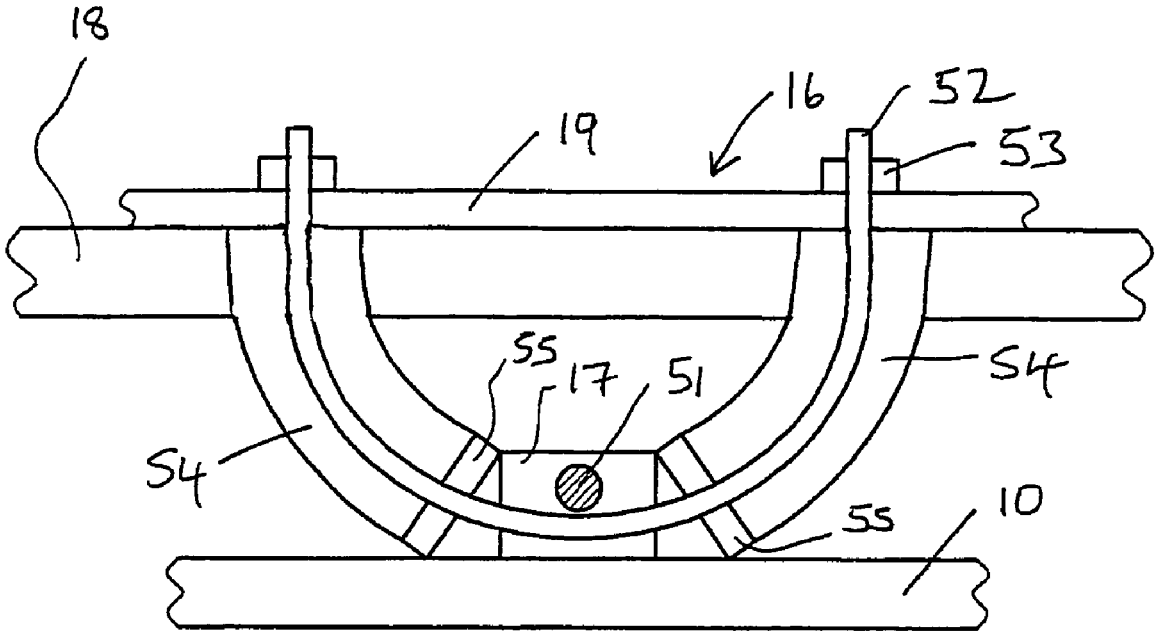

FIG. 5*b* is a side view of an embodiment of an all terrain board showing a deck structure with a front end similar to the rear end with raised portions which respectively extend over the wheel axis and a lower central portion which extends below the wheel axis;

FIG. 6 is a sectional view along the line VI—VI of FIG. 1;

FIG. 7 is a sectional view along the line VII—VII of FIG. 1;

FIG. 8 is a plan view of an alternative embodiment of all terrain board in accordance with this invention;

FIG. 9 is a side view of the board of FIG. 8;

FIG. 10 is a rear of the board in FIG. 8;

FIG. 11 is a front rear of the board in FIG. 8;

FIG. 12 is a perspective view, from the front and above, of the front end of the board in FIG. 8;

FIG. 13 is a perspective view, from the front and above, of the rear end of the board in FIG. 8;

FIG. 14 is a plan view of one end of the board of FIG. 9;

FIG. 15 is a sectional view along the line XV—XV of FIG. 14; and

Figure 16:
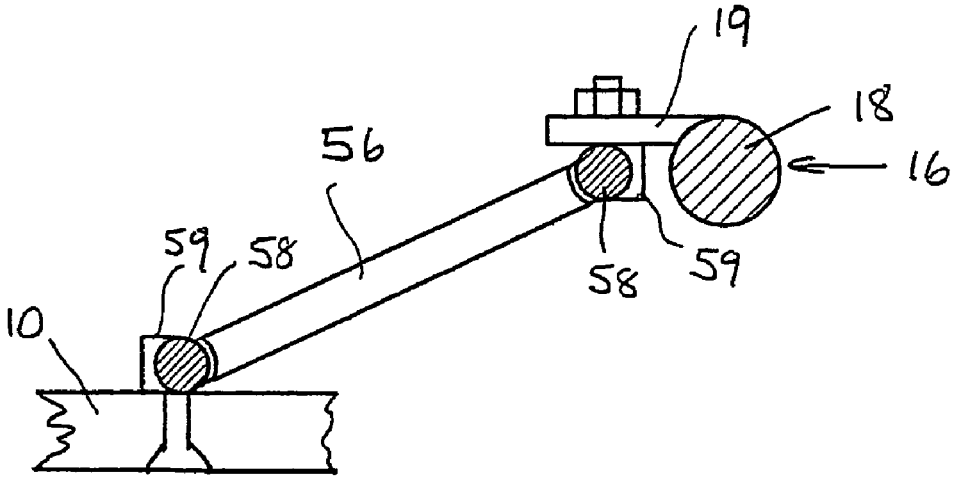

FIG. 16 is a sectional view along the line XVI—XVI of FIG. 14.

DETAILED DESCRIPTION OF THE PREFERRED EMBODIMENTS

Referring to FIGS. 1 to 5 of the drawings, there is shown an all-terrain board comprising an elongate deck structure 10 having a front end 11 and an upturned rear end 12. A pair of axle assembles 13, 14 are respectively mounted transverse the deck structure 10 adjacent the front and rear ends 11, 12 thereof.

A pair of wheels 15 are mounted at respective opposite ends of each axle assembly 13, 14 for rotation about respective axes which extend transverse the deck structure 10. Each wheel 15 preferably carries a pneumatic tire and has a diameter of 6 to 12 inches.

A substantial portion of the deck structure 10, including the central portion between the axle assemblies 13, 14, is flat and lies in a plane which extends parallel to the ground-contacting bottom surface of the wheels 15. The front end 11 of the deck structure 10, which may be slightly upturned, does not project forwardly of the front pair of wheels 15. The rear end 12 of the deck structure 10 extends rearwardly, substantially beyond the rear pair of wheels 15, and upwardly to a point which is disposed above the axis of wheel rotation and below the top surface of the wheels 15.

The axle assembles 13, 14 are mounted to the upper side of the deck structure 10, such that the axis of wheel rotation extends above the deck structure 10. Each axle assembly 13, 14 comprises an elongate axle 16, which is connected intermediate its opposite ends to a mounting or so-called base plate 17 that is securely attached to the upper surface of the deck structure 10.

Referring to FIG. 6 of the drawings, the axle 16 comprises an elongate shaft 18 on which the wheels 15 are mounted at opposite ends thereof. An elongate axle plate 19 extends axially of the shaft and projects radially outwards therefrom towards the deck structure 10, at an angle (which is inclined rearwardly in the case of the front axle assembly 13 and forwardly in the case of the rear axle assembly 14. Thus, whilst the axle assembles 13, 14 are substantially identical in construction, they are arranged at 180° to each other, as shown in FIG. 1 of the drawings.

The base plate 17 of each axle assembly 13, 14 comprises two opposed L-section elongate members 20, which extend axially of the deck structure 10, and which are interconnected intermediate their opposite ends by a bar 21 extending transverse the deck structure 10. The center of the axle 16 is supported intermediate its opposite ends on an elastomeric mounting block 22, which is seated between the two elongate members 20 of the base 17.

An inverted U-shaped bar 23 is attached at its opposite ends to the transverse bar 21 of the base 17, intermediate opposite ends thereof. A U-shaped bolt 24 extends through the eye formed by the inverted U-shaped bar 23, with opposite ends of the bolt 24 extending through respective apertures formed in the axle plate 19 of the axle 16. A pair of threaded nuts are fastened to respective opposite ends of the U-shaped bolt 24 to securely clamp the axle 16 to the base 17 of the axle assembly.

It will be appreciated that the aforementioned coupling between the axle 16 and the base plate 17 of the assembly allows opposite ends of the axle 16 to move upwardly, downwardly, forwardly and rearwardly within the confines of a circle.

Referring to FIG. 7 of the drawings, in order to initiate turning and prevent undue movement of each end of the axle 16, each end of the axle 16 is connected to the deck structure 10 by a strut 26, which is connected at its opposite ends to the axle plate 19 and the deck structure 10 respectively. The strut 26 comprises a metal strip having apertures at its opposite ends which receive respective bolts 27 that secure the strut 26 to the relevant structure. An elastomeric O-ring 28 is positioned on the bolt 27 on opposite sides of the strut 26. A pair of washers 29 are also positioned on the bolt 27, such that the strut 26 is resiliently constrained between the two O-rings 28, when the securing nut 30 is tightened. The bolt 27 which fastens the strut 26 to the deck structure 10, preferably comprises a head which is countersunk into the underside of the deck structure, so that the underside of the deck structure is free from protrusions.

The base plate 17 of the rear axle assembly 14 is more elongated than that of the front axle assembly 13, in order to provide the additional strength that is required to enable the board to be ridden with the front wheels 15 raised off the ground, as will be described hereinafter. The elongate members 20 of the rear base 17 are curved upwardly at their rear ends to follow the shape of the upturned rear end 12 of the deck structure 10. The members 20, which are L-shaped in section, thereby serve to strengthen the upturned end and prevent the deck structure 10 from breaking when the necessary large forces are applied to the upturned end 12 during use.

In use, a rider stands on the upper surface of the deck structure, placing one foot between the axle assembles 13, 14 and the other foot behind the rear axle assembly 14, on the upturned rear end 12 of the deck structure 10. Foot straps (not shown) are preferably provided at these positions.

In order to manoeuver the board, the rider can apply their weight either to the right or left side of the deck structure, to cause the axle 16 to pivot relative to their bases 17, about the central mounting block 22 thereof. In order to perform freestyle turns, the rider may apply weight to the upturned rear end 12 of the deck structure, to cause the front wheels 15 to lift off the ground. The board may then be redirected whilst the front wheels 15 are off the ground. Also, the upturned end enables the rider to raise the front of the board to ride over obstacles or to mount objects such as logs.

It will be appreciated that the underside of the deck structure 10 is completely free of any protrusions and thus the board is able to slide over any obstacles which may be encountered. Also, the rider is able to deliberately slide the board along obstacles such as logs. Considerably jumps can also be performed by springing off the kicktail or by using the kicktail as a lever.

The arrangement of the deck structure 10 below the axle 16 substantially lowers the center of gravity and makes the board much easier to ride and steer than conventional boards, in which the deck structure extends over the axles. The low center of gravity also helps to reduce speed wobbles. Most importantly, the low deck structure enables an upturned rear end 12 of sufficient size to be provided to form a kicktail.

Referring to FIGS. 8 to 14 of the drawings, there is shown an alternative embodiment of all-terrain board, which is similar in construction to the previous embodiment, and like parts are given like reference numerals.

In this embodiment, smaller wheels 15 are provided, with the wheels 15 of each axle assembly 13,14 being closer together and positioned in respective recesses 50 formed on opposite sides of the deck structure 10.

The main difference between this embodiment and the previous embodiment is the construction of the axle assemblies 13,14. This, referring particularly to FIGS. 12 and 13 of the drawings, the axle assemblies 13,14 each comprise a base 17 in the form of an elongate strip of metal, which is securely fastened to the upper side of the deck structure by countersunk bolts passed through the deck structure 10. The elongate base 17 of each assembly extends actually of the deck structure 10 and comprises a bridge portion 51 intermediate its opposite ends.

Referring to FIG. 15 of the drawings, a U-shaped bolt 52 extends under the bridge 51 and has its opposite balms extending through axially-spaced apertures in the axle plate 19. A pair of elongate tubular elastomeric members 54 are captively remounted on respective opposite sides of the U-shaped bolt 52, between the axle plate 19 and respective washers or other members 55 disposed on opposite sides of the base 17. Threaded nuts 53 are applied to respective opposite ends of the U-shaped bolt to securely fasten the axle 16 thereto.

It will be appreciated that the aforementioned coupling between the axle 16 and the base plate 17 of the assembly allows opposite ends of the axle 16 to move upwardly, downwardly, forwardly and rearwardly in the confines of a circle.

Referring to FIG. 16 of the drawings, in order to initiate turning and prevent an undue movement of each end of the axles 16, each end of the axle 16, is connected to the deck structure 10 by a strut 56, which is connected at its opposite ends to the axle plate 19 and the deck structure 10 respectively. The strut 56 comprises an elongate bar having balls 57 at its opposite ends, which are captively and rotatably received in respective sockets 59 secured to the relevant structure.

The board of the second embodiment can be ridden in exactly the same manner as that of the first embodiment. However, the wheels of each pair are mounted closer together and offer increased maneuverability, so that the board can be used by a high performance riders or younger riders with less height and body weight.

It will be appreciated that the board can be provided with a motor, brakes and suspension members. The underside of the deck structure may also be coated with a friction-reducing layer to enable the board to slide over obstacles.

An all-terrain board in accordance with this invention provides the combination and variety of performance criteria necessary to allow complete board riding in all-terrain environments with a high level of freestyle performance comparable to that which is available from other board sports such as skateboarding, surfing and snow boarding.

While the preferred embodiments of the invention have been shown and described, it will be understood by those skilled in the art that changes of modifications may be made thereto without departing from the true spirit and scope of the invention.

I claim:

1. An all-terrain board comprising:

an elongate deck structure having an upper surface, a lower surface, a front end, a central portion and an upturned rear end defining a kicktail;

front and rear wheels respectively mounted at said front and rear ends of the deck structure for rotation about respective wheel axes extending transverse the deck structure, each wheel having a radius;

a front and rear axle assembly pivotally mounted above the plane of the central portion of the deck structure, at least one wheel being mounted on each axle assembly, wherein each axle assembly is pivotable against a resilient bias provided by an elastomeric member; and an elongate strengthening member extending axially of the longitudinal axis of the elongate deck structure, said strengthening member being fitted to the deck structure above the lower surface of said deck structure and extending rearwardly along the deck structure from a point in front of the rear wheel axis to a point on said kicktail, wherein said central portion of the deck structure is disposed between said wheel axes and extends below the level of a plane defined by said wheel axes, to provide a front position for one of the rider's feet on said central portion, said kicktail extending upwardly and rearwardly within said rear wheel radius to a position diposed outwardly thereof, to provide a substantially support rear position for the rider's other foot behind said rear wheel which position is substantially above the plane defined by the said central portion of the deck structure.

2. An all-terrain board as claimed in claim 1, in which said kicktail of the board extends upwardly and rearwardly to a point substantially in-line with or above said plane defined by the wheel axes.

3. An all-terrain board as claimed in claim 1, in which the deck structure extends under the wheel axes.

4. An all-terrain board as claimed in claim 3, in which the wheels are mounted on respective axle assemblies mounted to the upper surface of the deck structure, such that the deck structure is suspended below the wheel axes.

5. An all-terrain board as claimed in claim 4, in which each axle assembly comprises an axle which is pivotally mounted relative to the deck structure.

6. An all-terrain board as claimed in claim 5, in which each axle is pivotable against an adjustable resilient bias.

7. An all-terrain board as claimed in claim 5, in which each axle is pivotable against a resilient bias provided by an elastomeric member mounted between the axle assembly and the deck structure.

8. An all-terrain board as claimed in claim 1, in which said elongate strengthening member forms a base of the rear axle assembly.

9. An all-terrain board as claimed in claim 1, in which said elongate strengthening member is fitted to the upper surface of the deck structure.

10. An all-terrain board as claimed in claim 6, in which each end of the axle is connected to the deck structure or the base of the axle assembly by a member, which limits the angle through which the axle can pivot relative to the board.

11. An all-terrain board as claimed in claim 10, in which the member comprises a rigid strut having a coupling at one or both of its ends which allows movement of axle relative to the deck structure.

12. An all-terrain board as claimed in claim 1, in which said front end of the deck structure has a similar structure to the rear end of the deck structure.

13. An all-terrain board as claimed in claim 1, in which said elongate strengthening member extends forwardly and rearwardly of the rear wheel axis, the forward extension being greater than the rearward extension.

* * * * *